United States Patent [19]

Parker

[11] Patent Number: 4,703,830

[45] Date of Patent: Nov. 3, 1987

[54] SAW BUCK

[76] Inventor: James E. Parker, 3280 Leyden St., Denver, Colo. 80207

[21] Appl. No.: 860,048

[22] Filed: May 6, 1986

[51] Int. Cl.[4] ..... B27B 21/00

[52] U.S. Cl. ..... 182/151; 182/181; 182/224; 108/158; 269/902

[58] Field of Search ..... 182/151, 181–186, 182/224–226, 154; 108/158; 269/902

[56] References Cited

U.S. PATENT DOCUMENTS

| | | | |
|---|---|---|---|
| 321,221 | 6/1885 | Johnson | 182/151 |
| 467,081 | 1/1892 | Church | 182/151 |
| 2,635,013 | 4/1953 | Doucette | 182/151 |
| 2,698,771 | 1/1955 | O'Rourk | 182/151 |
| 3,976,163 | 8/1976 | Watkinson | 182/151 |
| 4,030,565 | 6/1977 | Chaput | 182/151 |
| 4,489,808 | 12/1984 | Voye | 182/155 |

*Primary Examiner*—Reinaldo P. Machado

[57] ABSTRACT

This saw buck structure is compact and light in weight. Primarily, it consists of a hollow rectangular frame having four legs stored within it when not in use, and a handle is provided on one of the sides of the frame, so as to easily carry the structure when not in use. A pair of studs receiving nuts and wing nuts are provided, which secures the legs in the confines of the frame when the structure is not in use, and the fasteners also serve to support the frame in horizontal position for use, when the legs are placed in pairs within each end of the frame.

1 Claim, 7 Drawing Figures

FIG. 2
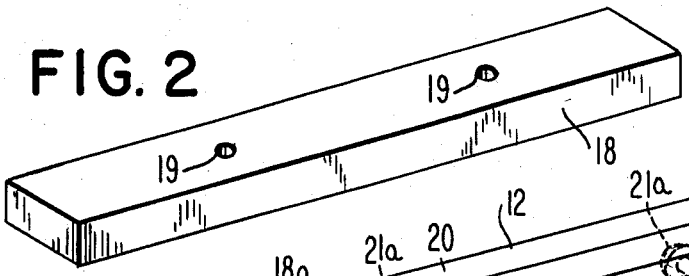
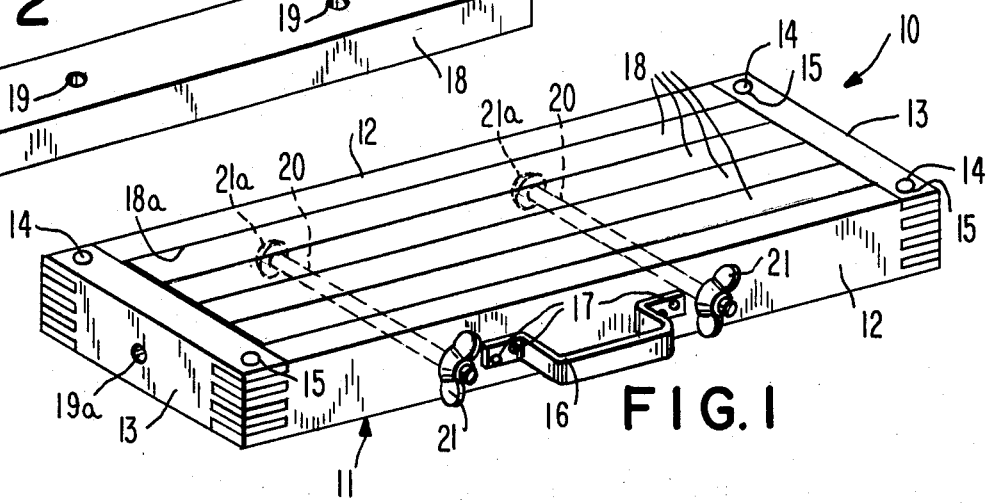
FIG. 1
FIG. 3
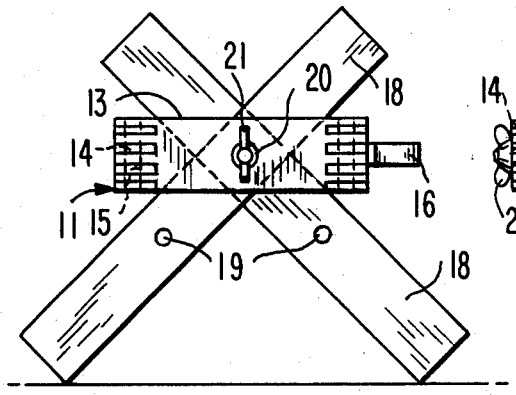
FIG. 4
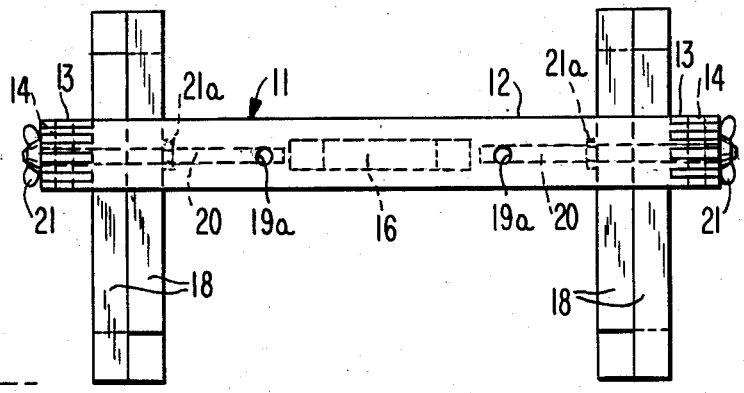
FIG. 6
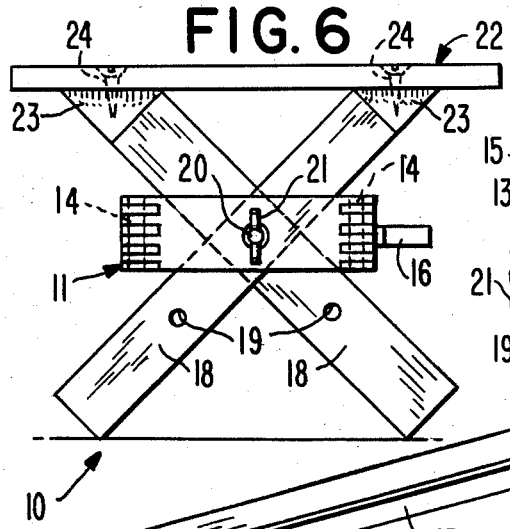
FIG. 5
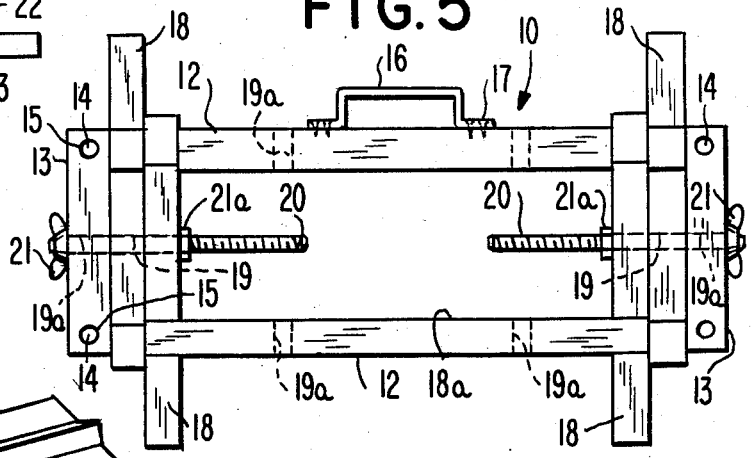
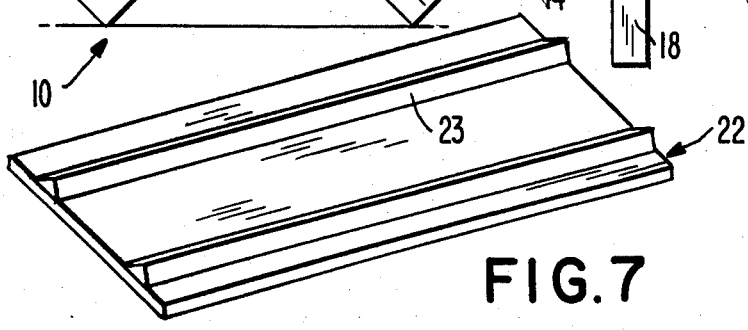
FIG. 7

SAW BUCK

BACKGROUND OF THE INVENTION

1. Field of the Invention

This invention relates to support devices, and more particularly, to a saw buck.

2. Description of Prior Art

References of record are the United States patents of Daniel Meyers U.S. Pat. No. 3,951,233, Daniel W. Poston, et al U.S. Pat. No. 4,245,718, Dan E. Barden U.S. Pat. No. 4,319,663, and Stephen A. Zieg U.S. Pat. No. 4,403,678.

The saw buck in accordance with the present invention, is designed to be self-storing in collapsible form, which includes a frame with four leg members that when used, are secured in their work position by means of studs, nuts, and wing nut fasteners, and the frame for the legs includes handle means for the unit or kit to be easily carried.

The principal object of this invention is to provide a saw buck, which will be of such design, as to be compact for storage and transport, and a frame is provided for the storage and set-up of four legs.

Another object of this invention is to provide a saw buck, which will be of such design, as to employ the frame for the bracing of the legs when in use, and the structure will be light in weight, while also being very sturdy for heavy duty use with a chain and buck saw, etc.

Another object of this invention is to provide a saw buck, which will be of such design, as to be compact and may also serve as a camp stool when desired.

A further object of this invention is to proivde a saw buck, which will be fabricated of Australian mahogany or other suitable wood, and may serve as emergency flotation means for the support of drowning victims, and it may even serve as an emergency fuel source.

An even further object of this invention is to provide a saw buck, which will be attractive in appearance and will serve as a fine conversation piece.

BRIEF DESCRIPTION OF THE DRAWINGS

FIG. 1 is a perspective view of the present invention, shown prior to being set up for work;

FIG. 2 is a perspective view of one of the legs, shown removed from the assembly of FIG. 1;

FIG. 3 is an end view of the invention, shown in its assembled condition for work use;

FIG. 4 is a left side view of FIG. 3, shown in elevation;

FIG. 5 is a top plan view of FIG. 4;

FIG. 6 is an end view similar to FIG. 3, but illustrates a modified form of the invention, and FIG. 7 is a perspective view of the top member of FIG. 6, shown inverted.

SUMMARY OF THE INVENTION

A saw buck structure, comprising a hollow rectangular frame storing four legs when stored or carried. The frame includes a handle on one side and the legs are held in the stored position by stud and nut fastener means. When the structure is used, the frame aids in supporting the legs, by serving as stop means against their further spread, and the legs are held in pairs when in the work position, by the studs being received in the end members of the frame of the structure.

DETAILED DESCRIPTION

Accordingly, a structure 10 is shown to include an open rectangular frame 11, having a pair of side members 12 and a pair of end members 13, which are tongue and groove joined together at their ends, and are further joined together by dowel pins 14 received in corner openings 15. A carry handle 16 is provided and secured to one side member 12, by suitable fasteners 17. Four legs 18 are received within the opening 18*a* of frame 11, and when stored therein, are flush with the longitudinal side edges of frame 11. A pair of openings 19 are provided through each of the four legs 18, and openings 19 align with similar openings 19*a* through the side members 12 of frame 11, for receiving studs 20 that receive their nut fasteners 21 and 21*a* which retain legs 18 within the confines of opening 18*a* when structure 10 is stored. An opening 19*a* is also provided through the end members 13, for receiving the studs 20 when the structure 10 is set up for use, as illustrated in FIGS. 3 and 4.

In use, the studs 20 are removed from the structure 10 after removing the wing nut fasteners 21 and nuts 21*a*. The structure 10 is then assembled into its work position by placing a pair of the four legs 18 at each end of the opening 18*a* in the frame 11 and inserting the studs 20 in the openings 19*a* of end members 13 and an appropriate opening 19 in the legs 18. With the bottom portions of the legs 18 spread and their respective longitudinal side edges engaging the side members 12, the wing nut fasteners 21 and nuts 21*a* are tightened on the studs 20, which will keep the legs 18 rigid in their spread condition, and it shall also be noted, that the inside corner edges of the opening 18*a* in frame 11, will serve as stop means for preventing outward movement of the bottoms of legs 18.

It shall also be recognized, that the nut fasteners 21*a* serve as jam nut means in conjunction with the wing nut fasteners 21, to hold the legs 18 firmly in the frame 11, as illustrated in FIGS. 4 and 5 of the drawing.

Referring now to FIGS. 6 and 7, structure 10 is modified to include a table top 22 for enabling structure 10 to serve as a portable light weight table. The top 22 is provided with a pair of triangular rails 23 which are suitably secured to one side surface of top 22, and rails 23 are secured thereto, by screw fasteners 24. The angled surfaces of rails 23 are such, that they matingly engage with the ends of the angularly positioned ends of the legs 18, and the cooperation is such, that forward and rearward movement are restricted of the top 22, but end movement is not prevented.

In use, the function of structure 10 is the same, as was heretofore described, with the exception, that modified 10 may also serve as a table as well, for picnics, etc.

While various changes may be made in the detail construction, such details will be within the spirit and scope of the present invention, as defined by the appended claims.

What I now claim is:

1. A saw buck structure, comprising, a frame, four legs removably received in said frame in an opening defined by a pair of side members and a pair of end members, and a pair of openings are provided and spaced from each other through said pair of side members and each of said legs, a pair of threaded studs extending through said openings, a pair of wing nut fasteners, and a pair of jam nut fasteners, said wing nut fasteners being received on said studs on the outside of said frame and rendering said legs secure in a stored position in the opening defined in said frame when said jam nut fasteners are also received on said pair of studs, wherein when in operative position said threaded studs are removed and a pair of said four legs are engaged with each other and are placed against said end members, and one of a pair of openings provided through said legs is aligned with an opening provided in said end members and receives said studs that received said wing nut fasteners and said jam nut fasteners, and when tightened, said wing nut fasteners and said jam nut fasteners secure said legs in a cross-configuration within said frame, that causes said frame to be supported above a surface in a horizontal position that supports a chain and buck saw other item.

* * * * *